United States Patent [19]

Zierhut

[11] Patent Number: 4,702,449

[45] Date of Patent: Oct. 27, 1987

[54] CARDAN BALL SUSPENSION FOR MOTION SENSOR

[75] Inventor: Hermann Zierhut, Munich, Fed. Rep. of Germany

[73] Assignee: Richard Hirschmann Radiotechnisches Werk, Fed. Rep. of Germany

[21] Appl. No.: 854,874

[22] Filed: Apr. 23, 1986

[30] Foreign Application Priority Data

Apr. 23, 1985 [DE] Fed. Rep. of Germany ..... 3514570

[51] Int. Cl.[4] ..... E04G 3/00

[52] U.S. Cl. ..... 248/288.3; 248/181

[58] Field of Search ..... 248/288.3, 663, 481, 248/484, 371, 181; 403/90, 114, 131, 115, 122, 144, 128; 285/268, 160, DIG. 8

[56] References Cited

U.S. PATENT DOCUMENTS

| | | | |
|---|---|---|---|
| 883,811 | 4/1908 | Kraus | 403/90 X |
| 1,194,772 | 8/1916 | Bothwell | 403/90 X |
| 1,472,566 | 10/1923 | Oishei | 403/90 X |
| 1,720,982 | 7/1929 | Brunt | 248/288.3 X |
| 2,089,463 | 8/1937 | Woller | 403/90 X |
| 4,043,686 | 8/1977 | Hackett | 248/288.3 X |
| 4,332,500 | 6/1982 | Smith | 403/114 |
| 4,365,779 | 12/1982 | Bates | 248/371 |

FOREIGN PATENT DOCUMENTS

| | | |
|---|---|---|
| 0012280 | 11/1979 | European Pat. Off. . |
| 2653110 | 8/1981 | Fed. Rep. of Germany . |
| 3128256 | 2/1983 | Fed. Rep. of Germany . |

OTHER PUBLICATIONS

Derwent Patent Search of Patent file EP 0012280.

*Primary Examiner*—J. Franklin Foss
*Attorney, Agent, or Firm*—Robert J. Koch

[57] ABSTRACT

A cardan ball suspension having a concentric strap relative to the ball or sphere to be adjusted. The strap exhibits a transverse slot. A radially protruding cog having a rectangular cross-section projects into the longitudinal slot and slides therein. The ball may be pivoted within a spherical angle zone without rotation of a surface element of the ball in relation to its normal or axis. The strap is preferably made of an elastic material and presses the ball against a holder ring.

12 Claims, 2 Drawing Figures

FIG. 1
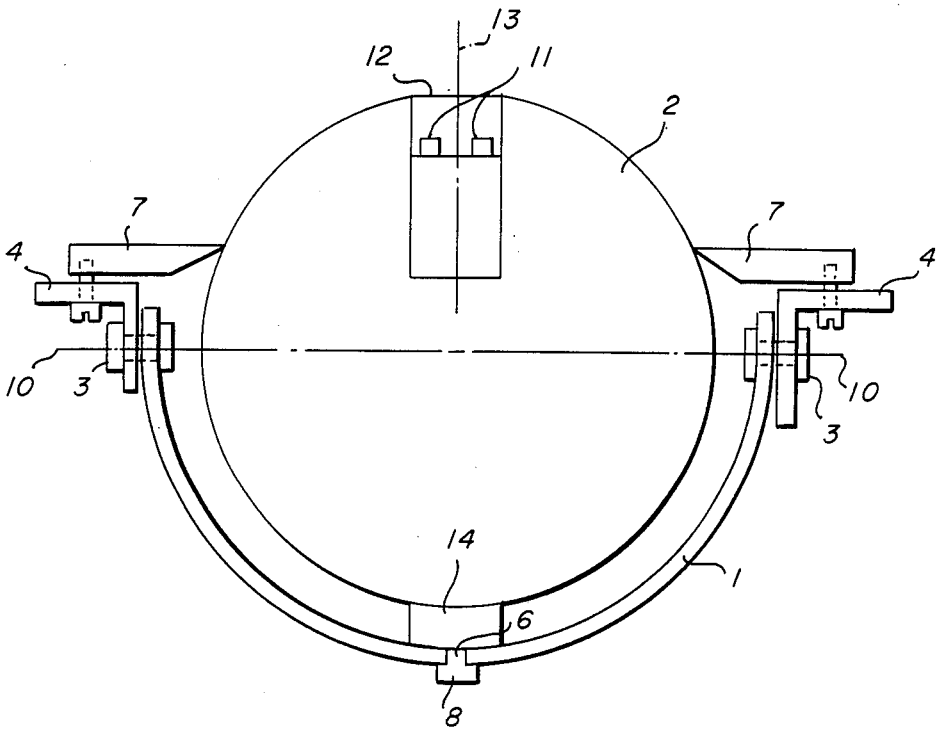
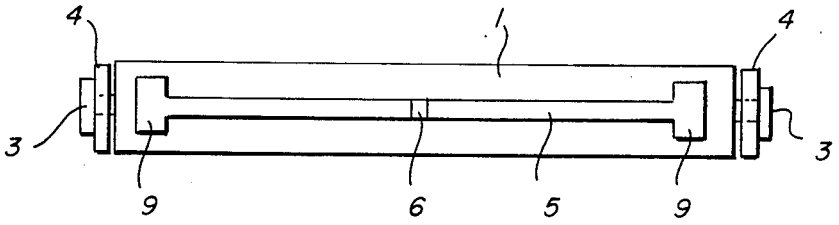
FIG. 2

CARDAN BALL SUSPENSION FOR MOTION SENSOR

BACKGROUND OF THE INVENTION

1. Field of the Invention

The invention relates to a cardan ball suspension.

2. Description of the Related Art

Conventional ball suspensions are used to align a particular point of the spherical surface over a spherical angular range. In conventional cardan ball suspensions this requires two articulations or a double articulation in order to set any spherical angle within a certain spherical angle range.

A ball suspension or a universal ball joint suspension associated with an intrusion protection detector, wherein the sensor of the detector is arranged in the ball or the spherical cap concentrically surrounding the sensor opening is shown in EP-A-12280. The sensor opening may be pivoted over a certain spherical angle range into all directions by rotating the spherical cap in a supporting layout. Rotation of the ball in relation to the sensor axis or the normal to the sensor surface is possible and unavoidable during such pivoting of the spherical cap.

Axial rotation of a ball suspension and sensor, detector, or reflector surface is acceptable only if the surfaces or the beams emitted by the surface or impacting it are symmetrical in rotation when sensors or other devices such as detectors, reflectors, or the like are used in combination with a ball suspension. A conventional suspension is not suitable for adjustment and aligning of a device used in combination with a ball suspension if there is no rotational symmetry or different symmetries prevailing in connection with the surfaces or beams.

Space monitoring indicating devices typically comprising more than one, preferably two, sensors for electromagnetic radiation and, in particular, infrared radiation are radiating or receiving devices which do not exhibit rotational symmetry. If two emitters or detectors are used in combination, there is no rotational symmetry with respect to the emitter or rotation axis but rather a plane symmetry. Emitters or detectors housed in tubes with rectangular cross sections wherein at least two opposing internal surfaces and directed onto one or several sensors, again are not devices exhibiting rotational symmetry. An indicating device of this type is shown in DE-B No. 26 53 110. Conventional ball or universal ball joint suspensions are not suitable for use in combination with non-rotationally symmetrical sensors, detectors or emitters. During adjustment or setting or pivoting the ball or spherical cap of a conventional suspension, rotation around the sensor, detector, or emitter axis occurs and cannot be prevented.

SUMMARY OF THE INVENTION

It is contemplated that the present suspension be utilized in connection with space surveillance and indicating devices exhibiting two spaced apart sensor elements operating in a push-pull cycle. Similar sensors are shown in DE-A No. 31 28 256. Such detector devices produce disk-shaped receiving segments or beams aligned in a plane and alternating in the horizontal direction. If a person moves in the horizontal direction within the area under surveillance, he is identified as an intruder by the positive and negative output pulses produced by the detector, whereas movement in the vertical direction, such as that of snow flakes, rain or warm air rising from heaters does not cause actuation.

The receiving beams and segments of indicating devices of this type are intentionally aligned in a single plane or segment. The use of conventional ball or universal ball joint suspension is not possible in combination with such receiving or emitting devices, as the pivoting or displacement of the detector within a spherical angular range also involves a rotation symmetrical twisting of the detector or emitter axis. In a rotationally symmetrical turn of the sensor, the detector would not detect a movement in the horizontal direction as expected, but rather a movement in the vertical direction.

It is an object of the invention to provide a cardan ball suspension where it is possible to pivot a ball or a spherical cap within a spherical angular zone without a rotation of the ball or the spherical cap around the radius of the ball or axis of the sensor. The cardan ball suspension is further to be of a simple configuration, easily pivotable and simple to adjust.

This object is achieved according to the invention by a cardan ball suspension having a strap supported at its end by pivoting joints essentially concentric with the ball. The strap has a longitudinal slot extending over a portion of its length. A cog with a rectangular cross section radially protrudes from the ball into said longitudinal slot of the strap. A ball holder is provided which rests against the spherical surface of the ball.

It is possible to arbitrarily pivot the ball within a spherical angular range without involving a rotation of the ball with respect to the axis of an indicating device. The cog projecting from the ball has a rectangular cross section and thus cannot rotate in the longitudinal slot of the strap, but can only slide in it by virtue of the cooperation of the slot with the radially projecting cog whose width corresponds to that of the longitudinal slot in the strap.

According to a preferred embodiment of the invention, means for holding the ball comprise a ring which rests against the surface of the hemisphere facing away from the strap. In this manner, the ball is held securely and the penetration of dust or humidity into the cardan mechanism prevented.

It is particularly advantageous to make the strap of an elastic material, so that the ball is elastically pressed against the holding ring. In this manner, the ball is immobilized in its set position and held herein without the need for additional screws or other means for the fixation of the ball. Simultaneously, the contact pressure of the ball holder ring on the surface of the ball results in enhanced sealing of the cardan suspension against environmental effects, such as dust or humidity. The sealing and the pressure of the ring against the surface of the ball is further improved by a ring with an elastic layer, such as a rubber coating, resting against the spherical surface. This further enhances fixing the position of the ball.

The application of the cardan ball suspension according to the invention is especially suitable in connection with radiation sensors and/or receivers, which are arranged in the ball. The emitting or receiving segments, zones or beams, aligned in a particular direction and not rotated symmetrically, maintain their alignment in spite of the pivoting of the ball.

The cardan ball suspension according to the instant invention is particularly well suited for use in connection with indicator devices for the protection of objects and against intrusion due to its simple configuration and ease of manipulation. The manipulation, i.e., the setting of the emitter or receiver to a certain spherical angle zone, is extraordinarily simple. It is not even necessary to secure the position set by a screw if an elastic strip is utilized. Due to the extremely simple configuration the simultaneous sealing of the suspension mechanism against external effects such as dust and humidity, the manufacturing effort is low and the operational readiness of the device is assured over long periods of time.

BRIÉF DESCRIPTION OF THE DRAWINGS

The invention will be more apparent from the description below with reference to the drawings. In the drawings:

FIG. 1 shows a lateral cross-section through an embodiment of the cardan ball suspension according to the invention in a schematic view.

FIG. 2 shows a top view of the rotatable strap.

DETAILED DESCRIPTION OF THE PREFERRED EMBODIMENT

As seen in FIGS. 1 and 2, the strap 1, which is arranged essentially in a concentric manner in relation to a ball 2, is adjustable in its spherical position. The ends of the strap are connected by pivoting joints to supports 4. As seen more particularly in FIG. 2, the strap comprises a longitudinal slot 5 which extends in the longitudinal direction of the strap 1 and has the same width over its entire length.

The ball 2 is provided with a radially protruding cog 6 having a rectangular cross-section to facilitate adjustment of the ball's spherical position as seen in FIG. 2. The cog 6 extends into the longitudinal slot 5 of the strap 1. Rotation of the ball 2 around the axis of the cog 6 is prevented by matching the width of the slot and the fixed connection of the ball 2 to the cog 6. The only rotation of the ball 2 relative to the strap is in the longitudinal direction of the slot 5.

The ball 2 is held on the hemisphere facing away from the cog 6 by a holder ring 7 resting against the surface of the ball 2.

If the holder ring 7 is removed, the ball may be inserted into the cardan suspension by inserting the cog 6 with its rectangular cross-section into the longitudinal slot 5 of the strap 1. The cog 6 remains in the longitudinal slot 5 of the strap 1 on its own following the mounting of the retaining or holder ring 7. A retaining element 8 with larger dimensions than the cross-section of the cog, may be provided at the end of the cog 6, either integrally with the cog or fastened to it for added safety. Enlarged recesses 9 may be provided at the ends of the longitudinal slot 5 in order to facilitate insertion of the cog 6 into the longitudinal slot 5 of the strap 1. The retaining element 8 is inserted through recesses 9 during assembly of the cardan ball suspension in the embodiment shown.

The spherical angle position of a point on the surface of the ball 2 may be set by rotating the pivoting joints of strap 1 and longitudinally displacing cog 6. If the cardan ball suspension is used in connection with an indication sensor or receiver 11 such as an infrared sensor, the sensor surface 12 may be aligned with the desired angle zone. As discussed above, no rotation of the sensor around its sensor axis 13 is permitted so that the receiver or emitter beams, aligned in one direction, retain that alignment during the adjustment.

The strap 1 preferably comprises an elastic material, such as spring bronze and is prestressed toward the holder ring 7. The strap 1 therefore presses against a shoulder 14 resting against the strap 5 and presses the ball 2 against the holder ring 7. In this manner the ball 2 remains in its position following the adjustment, without requiring special mounting elements, fastening screws or the like. Simultaneously, the pressure of the ball 2 against the holder ring 7 provides a good seal of the cardan ball suspension against the outside due to the elastic strap. Dirt, humidity and other harmful substances cannot enter the housing (not shown) of the ball suspension, thereby preserving the operating ability of said suspension over extended periods of time. The sealing effect may be further enhanced by the use of an elastic lip on the holder ring 7.

What is claimed is:

1. A cardan ball suspension comprising:

a ball;

a strap exhibiting a longitudinal slot extending over a portion of the straps length, said strap arranged essentially concentrically with said ball;

a pivoting joint connected to each end of said strap;

a cog, extending radially from said ball and exhibiting a rectangular cross-section cooperates with said longitudinal slot, allowing only longitudinal rotation of said ball relative to said strap; and means for retaining said ball resting against a spherical surface of said ball.

2. A cardan ball suspension according to claim 1, wherein the means for retaining is a ring resting on a hemisphere facing away from said strap against the surface of the ball.

3. A cardan ball suspension according to claim 2, wherein said ring exhibits an elastic layer resting against the surface of the ball.

4. A cardan ball suspension according to claim 3, wherein said strap induces a force, pressing the ball against the means for retaining.

5. A cardan ball suspension according to claim 4, further comprising an indicating device associate with said ball.

6. A cardan ball suspension according to claim 1, wherein said strap induces a force, pressing the ball against the means for retaining.

7. A cardan ball suspension according to claim 1, further comprising an indicating device associated with said ball.

8. A cardan ball suspension according to claim 5, wherein said indicating device is a directionally aligned means for sensing motion.

9. A cardan ball suspension according to claim 3, wherein said elastic layer comprises means for sealing against dust and humidity.

10. A cardan ball suspension according to claim 8, further comprising a shoulder associated with said cog disposed between said strap and said ball.

11. A cardan ball suspension according to claim 10, further comprising a retaining element associated with said cog extending beyond said strap.

12. A cardan ball suspension according to claim 11, further comprising an enlarged recess associated with said transverse slot, said recess being at least as large as said retaining element.

* * * * *